US009220316B2

(12) United States Patent
Kim

(10) Patent No.: US 9,220,316 B2
(45) Date of Patent: Dec. 29, 2015

(54) INNER SOLE INCLUDING AN AIR BAG

(76) Inventor: Seong Sun Kim, Busan (KR)

( * ) Notice: Subject to any disclaimer, the term of this patent is extended or adjusted under 35 U.S.C. 154(b) by 449 days.

(21) Appl. No.: 13/808,360

(22) PCT Filed: Dec. 13, 2010

(86) PCT No.: PCT/KR2010/008899

§ 371 (c)(1),
(2), (4) Date: Jan. 4, 2013

(87) PCT Pub. No.: WO2012/005419

PCT Pub. Date: Jan. 12, 2012

(65) Prior Publication Data

US 2013/0118029 A1 May 16, 2013

(30) Foreign Application Priority Data

Jul. 5, 2010 (KR) ..... 10-2010-0064377

(51) Int. Cl.
*A43B 13/20* (2006.01)
*A43B 17/03* (2006.01)
*A43B 7/14* (2006.01)

(52) U.S. Cl.
CPC ..... *A43B 13/20* (2013.01); *A43B 7/141* (2013.01); *A43B 7/143* (2013.01); *A43B 7/144* (2013.01); *A43B 7/146* (2013.01); *A43B 7/148* (2013.01); *A43B 7/1425* (2013.01); *A43B 17/03* (2013.01); *A43B 17/035* (2013.01)

(58) Field of Classification Search
CPC ..... A43B 13/20; A43B 17/03; A43B 17/035
USPC ..... 36/29, 44
See application file for complete search history.

(56) References Cited

U.S. PATENT DOCUMENTS

| | | | | |
|---|---|---|---|---|
| 1,145,533 | A * | 7/1915 | Wetmore | 36/153 |
| 4,779,359 | A * | 10/1988 | Famolare, Jr. | 36/29 |
| 5,353,459 | A | 10/1994 | Potter et al. | |
| 5,771,606 | A | 6/1998 | Litchfield et al. | |
| 5,794,361 | A * | 8/1998 | Sadler | 36/29 |
| 5,950,332 | A * | 9/1999 | Lain | 36/3 B |
| 6,453,577 | B1 | 9/2002 | Lichfield et al. | |
| 6,505,420 | B1 | 1/2003 | Litchfield et al. | |
| 6,845,573 | B2 | 1/2005 | Litchfield et al. | |

(Continued)

FOREIGN PATENT DOCUMENTS

| | | |
|---|---|---|
| EP | 0 641 527 | 3/1995 |
| KR | 10-2003-0018289 | 3/2003 |

(Continued)

OTHER PUBLICATIONS

International Search Report issued Aug. 25, 2011 in International (PCT) Application No. PCT/KR2010/008899.

*Primary Examiner* — Ted Kavanaugh
(74) *Attorney, Agent, or Firm* — Wenderoth, Lind & Ponack, L.L.P.

(57) ABSTRACT

An inner sole includes a heel air bag for supporting the heel and a first arch air bag for supporting the plantar arch which is connected to the heel air bag through a passageway. The heel air bag and the primary arch air bag are coupled to the bottom surface of the inner sole. A second arch air bag is disposed over the first arch air bag to communicate with the primary arch air bag. When the heel air bag is pressed, air pressure is uniformly applied to the second arch air bag through the first arch air bag.

3 Claims, 4 Drawing Sheets

(56) References Cited

U.S. PATENT DOCUMENTS

| | | | | |
|---|---|---|---|---|
| 7,181,867 | B2 | 2/2007 | Litchfield et al. | |
| 7,475,498 | B2 | 1/2009 | Litchfield et al. | |
| 8,015,730 | B2 * | 9/2011 | Hazenberg | 36/29 |
| 2003/0019128 | A1 | 1/2003 | Litchfield et al. | |
| 2003/0101619 | A1 | 6/2003 | Litchfield et al. | |
| 2005/0178025 | A1 | 8/2005 | Litchfield et al. | |
| 2007/0006488 | A1 | 1/2007 | Litchfield et al. | |
| 2009/0165333 | A1 | 7/2009 | Litchfield et al. | |

FOREIGN PATENT DOCUMENTS

| | | | |
|---|---|---|---|
| KR | 20-0400222 | 11/2005 | |
| WO | WO 9312685 A1 * | 7/1993 | A43B 13/20 |
| WO | 96/37124 | 11/1996 | |

* cited by examiner

INNER SOLE INCLUDING AN AIR BAG

BACKGROUND OF THE INVENTION

The present invention relates, in general, to a technology of an inner sole used in a shoe, and more particularly, to an inner sole assembly for a shoe which has an airbag coupled to the undersurface of the inner sole.

BACKGROUND ART

A shoe generally includes an under sole, a midsole and an inner sole. It is important for the under sole to have an anti-slip function, and the midsole is required to have a shock-absorbing function. The inner sole is a part that directly adjoins the sole of a foot, and is required to firmly surround and support the sole of the foot. In particular, it is known that the inner sole can improve comfort and be beneficial to physical health when it firmly supports the arch part of the sole of a wearer's foot.

Various sorts of inner soles with various characteristics depending on inner sole requirements have been disclosed. Representative technologies include Korean Registered Utility Model No. 121858 (hereinafter, referred to as Related Art 1) and Korean Registered Utility Model No. 121857 (hereinafter, referred to as Related Art 2).

FIG. 1 is a perspective view showing the underside part of a sole according to Related Art 1. As shown in the figure, a pad 2 made of synthetic resin is attached to the undersurface of the inner sole, and a heel air chamber 3, a middle air chamber 4 and a front air chamber 5 are coupled onto the pad 2. The chambers communicate with each other via air pipes 6 and 7. Since the chambers communicate with each other, impact that occurs during walking can be alleviated.

In Related Art 1, although impact during walking can be absorbed, there are problems in that the middle air chamber 4 cannot press an arch part of the sole of a foot since it is attached onto the pad 2. Since the arch part is positioned higher than the other parts, the chamber which is intended to support the arch part is required to be thicker and positioned higher than the other chambers which support the other parts. When the chamber which is to support the arch part is made to be thick, only the central section of the chamber which has a hollow space of a tube can protrude into a concave shape, such that the pressure is not uniformly distributed.

FIG. 2 is a perspective view of Related Art 2, in which a cover sheet (pad) 2 made of synthetic resin is bonded to an inner sole 1 such that air tubes 3 and 4 are respectively formed in a heel part and a recessed part. The air tubes 3 and 4 communicate with each other via a communication hole 10. However, Related Art 2 has a problem in that it cannot effectively press the arch part even though it can absorb impact.

SUMMARY OF THE INVENTION

Accordingly, the present invention has been made keeping in mind the above problems occurring in the related art, and is intended to provide an inner sole for a shoe which enables an arch part of the sole of a foot to be more effectively pressed in consideration of the position thereof, thereby improving comfort and increasing the effect of acupressure.

Technical Solution

In an aspect, the present invention provides an inner sole assembly for a shoe in which two airbags are connected to each other via a channel and are coupled to the undersurface of an inner sole such that the airbags support a heel part and an arch part of the sole of a foot. A first arch airbag is connected via the channel to a heel airbag which supports the heel part, and a second arch airbag overlies and is coupled to the first arch airbag such that the second arch airbag communicates with the first arch airbag. When the heel airbag is pressed, air pressure is uniformly applied to the first arch airbag and then the second arch airbag.

In the present invention, it is preferred that the heel airbag and the first arch airbag are positioned between the inner sole and an auxiliary sole which is coupled to the undersurface of the inner sole. When the heel airbag is pressed downward, the second arch airbag expands upward, thereby supporting the arch part of the sole of the foot.

It is preferred that the first arch airbag and the second arch airbag be stacked on each other while having the same shape.

It is preferred that the inner sole further have airbag recesses in the undersurface thereof, the recesses being depressed inward such that the heel airbag and the second arch airbag are respectively seated therein.

Advantageous Effects

According to the invention, the inner sole for a shoe which has an airbag has effects in that a wide area of the arch part of the sole of the foot is pressed due to uniform distribution of pressure on the arch part of the sole of the foot. It is therefore possible to improve comfort and provide beneficial effects of acupressure.

DETAILED DESCRIPTION OF THE INVENTION

Figure 1:
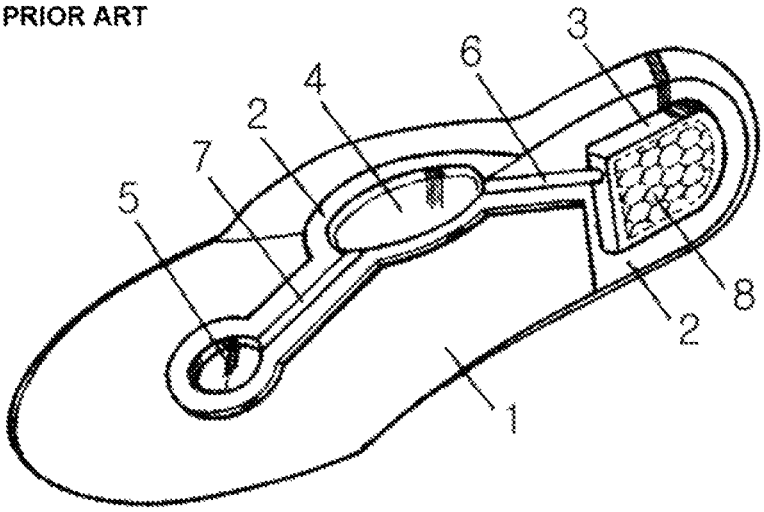
Fig. 1 PRIOR ART
FIG. 1 is a perspective view showing the underside part of a sole according to a first example of the related art.
Figure 2:
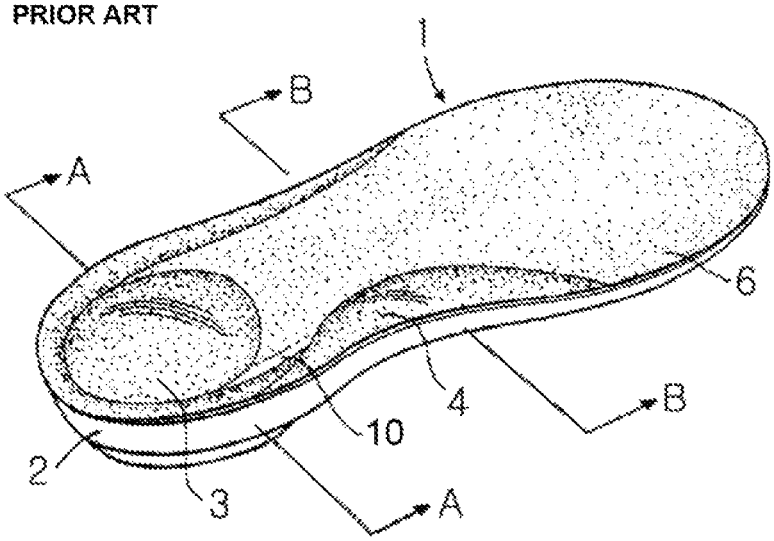
Fig. 2 PRIOR ART
FIG. 2 is a perspective view of a second example of the related art.

Reference will now be made in detail to various embodiments of the present invention, examples of which are illustrated in the accompanying drawings and described below, so that a person having ordinary skill in the art to which the present invention relates can easily put the present invention into practice. The present invention, however, can be embodied in various different forms and is not limited to embodiments which will be described hereinafter. In addition, those parts which are not related to the description are omitted from the accompanying drawings in order to clarify the description of the present invention, and the same reference numerals and signs are used throughout the specification in order to designate the same or similar components.

Unless explicitly stated to the contrary, the word "comprise," "comprises" or "comprising" used throughout the specification will not be understood as excluding other elements, but to imply the inclusion of the other elements.

Figure 3:
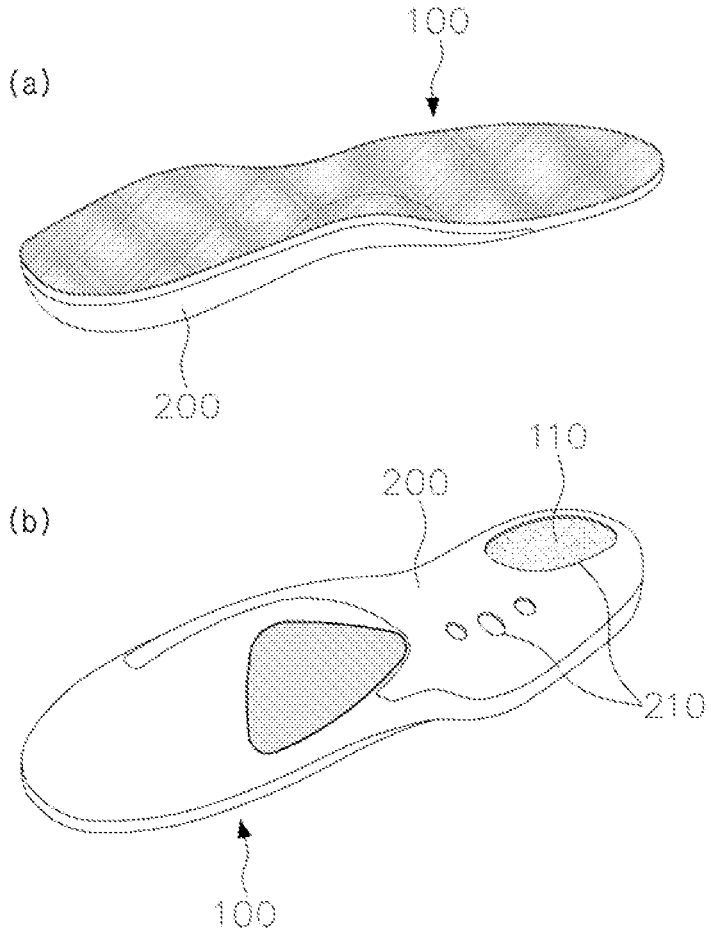
FIG. 3 is a perspective assembly view schematically showing an inner sole for a shoe which has an airbag according to an exemplary embodiment of the present invention.
Figure 4:
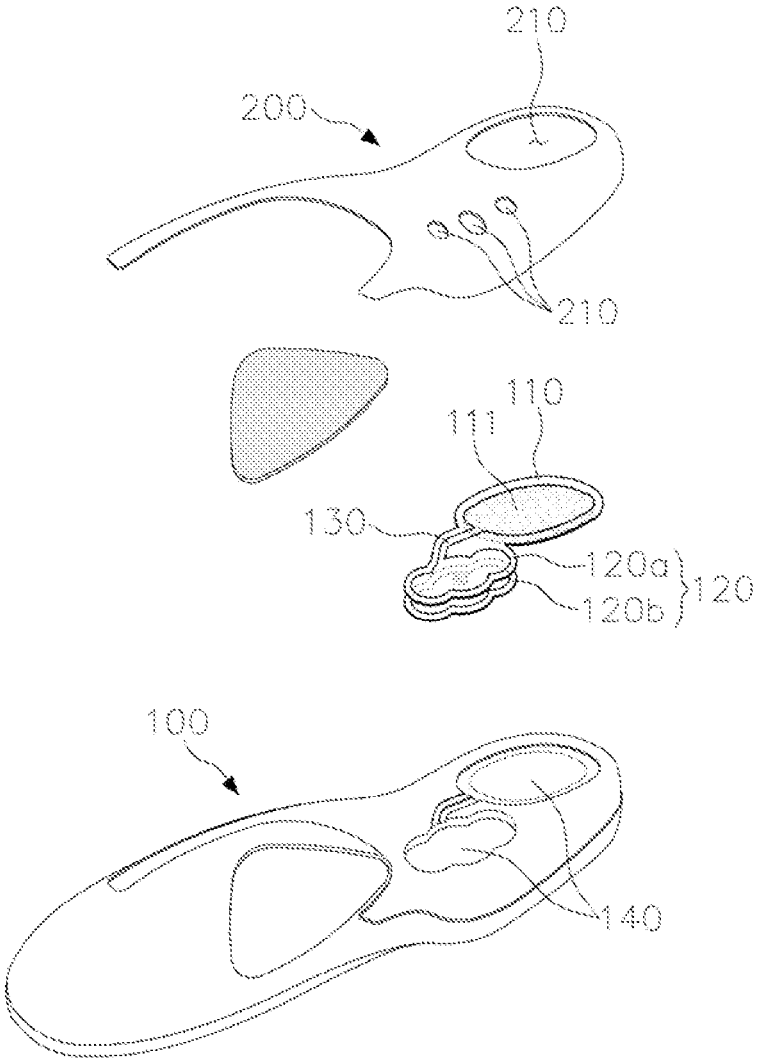
FIG. 4 is an exploded perspective view of FIG. 3.
Figure 5:
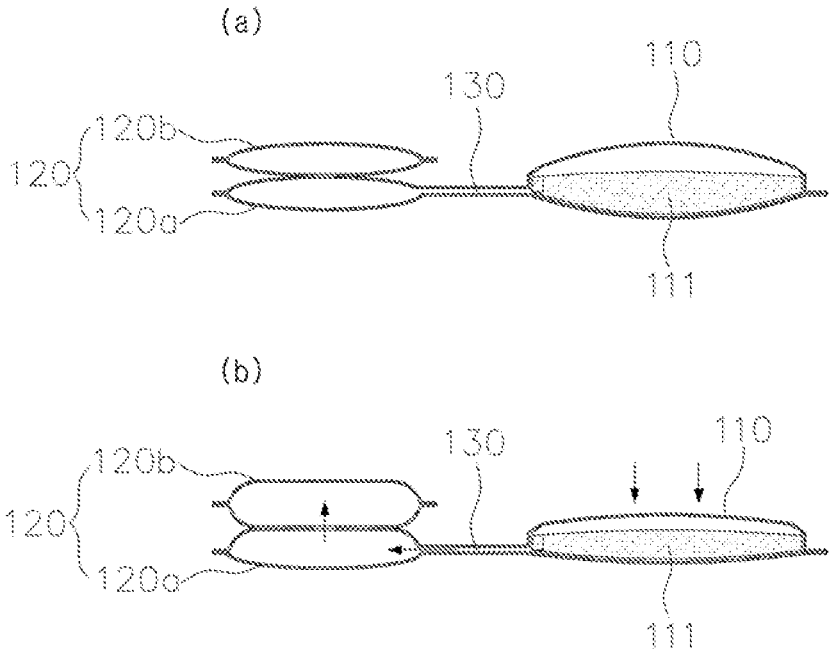
FIG. 5 is a cross-sectional view of the airbag shown in FIG. 4.

In the accompanying drawings, FIG. 3 is a perspective assembly view schematically showing an inner sole for a shoe (also referred to as "shoe inner sole") which has an airbag according to an exemplary embodiment of the present invention, FIG. 4 is an exploded perspective view of FIG. 3, and FIG. 5 is a cross-sectional view of the airbag shown in FIG. 4.

The shoe inner sole assembly of the present invention has two airbags 110 and 120 in the undersurface portions thereof which correspond to the heel part and the arch part of the sole of a foot. The airbags 110 and 120 are connected via a channel 130, and are coupled to a shoe inner sole 100. A first one of the airbags which supports the heel is referred to as a heel airbag 110, and a second one of the airbags which supports the arch part is referred to as an arch airbag 120.

In particular, according to an embodiment of the present invention, the arch airbag 120 includes a first arch airbag 120*a* and a second arch airbag 120*b* which are coupled to each other as if they overlap each other in the vertical direction (i.e., are stacked on each other) while communicating with each other, so that the arch part can be uniformly pressed.

More specifically, the heel airbag 110 is connected to the first arch airbag 120*a* via the channel 130, and the second arch airbag 120*b* is coupled to the first arch airbag 120*a* from above such that the first and second arch airbags 120*a* and 120*b* communicate with each other. Consequently, the insides of the heel airbag 110, the first arch airbag 120*a* and the second arch airbag 120 are connected together, such that air can circulate therethrough.

The present invention is configured such that, when load is applied to the heel airbag 110, the air inside the heel airbag 110 flows into the first arch airbag 120*a* and then finally enters the second arch airbag 120*b*. At this time, the first arch airbag 120*a* and the second arch airbag 120*b* press the arch part of the foot sole while expanding under the pressure of the air that occurs.

In particular, as for the structure according to an embodiment of the present invention, the first arch airbag 120*a* and the second arch airbag 120*b* which are independent from each other are arranged such that they are stacked up and down, thereby enabling the insides thereof to communicate with each other. Therefore, it is possible to sufficiently increase the entire height of the arch airbag 120. Since the independent first and second arch airbags 120*a* and 120*b* are coupled to each other, uniform pressure acts on the entire area of the second arch airbag 120*b* which directly presses the arch part.

That is, as described in the Background Art section, when the height is increased using a single arch airbag, the central portion is more expanded than the other portions when the airbag is expanded, thereby creating the problem of the concentrated pressure. However, in the present invention, the first arch airbag 120*a* and the second arch airbag 120*b* are connected into the double stacked structure, thereby uniformly distributing the pressure, which is advantageous.

In an exemplary embodiment of the present invention, an auxiliary sole 200 is coupled to the undersurface of the shoe inner sole 100, and the heel arch airbag 110, the first arch airbag 120*a* and the second arch airbag 120*b* are disposed between the shoe inner sole 100 and the auxiliary sole 200. That is, after the heel airbag 110 and the arch airbag 120 are positioned on the undersurface of the inner sole, the auxiliary sole 200 is fixedly coupled to the undersurface of the inner sole by surrounding the heel airbag 110 and the arch airbag 120 with the auxiliary sole 200.

When the airbags are disposed between the shoe inner sole 100 and the auxiliary sole 200, the second arch airbag 120*b* expands upward in response to load being applied downward to the heel airbag 110, thereby supporting the arch part of the sole of the foot. When the auxiliary sole 200 is coupled to the shoe inner sole 100, it is possible to prevent the shoe inner sole 100 from being spread outward. The first and second arch airbags 120*a* and 120*b* surrounded by the auxiliary sole 200 cannot be expanded downward. Consequently, the first and second arch airbags 120*a* and 120*b* are expanded upward, thereby effectively pressing the arch part of the sole of the foot.

In addition, the auxiliary sole 200 can have an exposure hole 210 through which the heel airbag 110 can be partially exposed. The auxiliary sole 200 can also have exposure holes 210 through which the first arch airbag 120*a* can be partially exposed. Since the presence of the airbag can be recognized by the naked eye through the exposure holes 210, it is possible to stimulate the purchasing desire of consumers.

In addition, the heel airbag 110 or the first and second arch airbags 120*a* and 120*b* are molded from a synthetic resin material such that a cavity is formed therein. The first arch airbag 120*a* and the second arch airbag 120 can be separately manufactured and then bonded together via thermal fusion. In addition, an elastic pad 111 may be provided inside the heel arch airbag 110 in order to assist in resilience and prevent the heel arch airbag 110 from being eccentrically deformed when it is pressed under load.

The first arch airbag 120*a* and the second arch airbag 120*b* have the same shape and are bonded to each other such that they are stacked on each other. When the first arch airbag 120*a* and the second arch airbag 120*b* have the same shape, the first arch airbag 120*a* underlies and supports the second arch airbag 120. This can consequently be helpful for more uniform pressure to be applied to the second arch airbag 120*b*.

According to an embodiment of the present invention, more preferably, the shoe inner sole 100 has airbag recesses 140 in the undersurface thereof which are depressed inward such that the heel airbag 110 and the second arch airbag 120*b* are seated therein. The heel airbag 110 and the second arch airbag 120*b* are respectively positioned in the airbag recesses 140, and then the auxiliary sole 200 is coupled to the undersurface of the shoe inner sole 100.

The thickness of the airbag recesses 140 formed in the undersurface of the shoe inner sole 100 can be set to be smaller than that of the other parts so that the arch part of the sole of the foot can be more efficiently pressed when pressure is applied to the second arch airbag 120*b*.

In addition, according to an embodiment of the present invention, the heel airbag 110 or the first and second air bags 120*a* and 120*b* can provide a shoe inner sole depending on the characteristics of users by varying the amount of air that is injected thereinto or the size thereof. In an example, the amount of air to be injected may vary depending on the sizes which are divided into large, medium and small. More specifically, the amount of air to be injected can be determined in consideration of the weight of users. That is, the amount of air can be increased with the increasing weight of wearers. In addition, the sizes of the heel airbag 110, the first arch airbag 120*a* and the second arch airbag 120*b* may vary depending on the sizes of feet so as to be applicable to all shoes ranging from shoes for kids to shoes for adults.

When a user walks in shoes to which the shoe inner sole of the present invention is applied, the heel airbag 110 is pressed and compressed since the heel part first adjoins the ground, thereby directing air into the first arch airbag 120*a* and the second arch airbag 120*b*. In the state in which the first arch airbag 120*a* underlies and supports the second arch airbag 120*b*, the second arch airbag 120*b* expands upward, and the arch part of the sole of the foot is consequently pressed by the second arch airbag 120*b*, so that comfort is improved and the effect of acupressure is provided. Of course, the shoe inner sole of the present invention also has the function of effectively alleviating impact which occurs during walking.

The foregoing description of the present invention has been presented for the purposes of illustration and description. It is apparent to a person having ordinary skill in the art to which the present invention relates that the present invention can be easily modified into other detailed forms without changing the technical principle or essential features of the present invention.

Therefore, the foregoing embodiments should be regarded as illustrative rather than limiting in all aspects. In an example, each component which has been described as a unitary part can be implemented as distributed parts. Likewise, each component which has been described as distributed parts can also be implemented as a combined part.

The scope of the present invention is presented by the accompanying Claims rather than the foregoing description. It should be understood that all changes or modifications derived from the definitions and scopes of the Claims and their equivalents fall within the scope of the present invention.

INDUSTRIAL APPLICABILITY

The shoe inner sole which has an airbag according to the present invention can be applied to various types of shoes.

The invention claimed is:

1. An inner sole assembly of a shoe said inner sole assembly comprising:

an inner sole;

a heel airbag for supporting a heel portion of a sole of a foot;

an arch airbag for supporting an arch portion of the sole of the foot, said arch airbag including:

a first arch airbag connected to said heel airbag via a channel so as to communicate with said heel airbag; and a second arch airbag overlying and coupled to said first arch airbag such that said second arch airbag communicates with said first arch airbag, said first arch airbag and said second arch airbag being stacked on each other in a vertical direction; and an auxiliary sole coupled to an undersurface of said inner sole while surrounding said heel airbag and said first arch airbag, wherein said inner sole, said arch airbag, and said auxiliary sole are configured such that, when said heel airbag is pressed, air pressure causes said first arch airbag and then said second arch airbag to expand upward, thereby supporting the arch portion of the sole of the foot.

2. The inner sole assembly of claim 1, wherein said inner sole has airbag recesses in said undersurface thereof, said airbag recesses being depressed inward such that said heel airbag and said second arch airbag are seated within respective airbag recesses.

3. The inner sole assembly of claim 1, wherein said first arch airbag and said second arch airbag are arranged such that said second arch airbag is to be located closer to the arch portion of the sole of the foot than said first arch airbag.

* * * * *